US008051813B2

(12) United States Patent
Spinnler

(10) Patent No.: US 8,051,813 B2
(45) Date of Patent: Nov. 8, 2011

(54) SCROLL COMPRESSOR WITH TWO SCROLLS

(75) Inventor: Fritz Spinnler, Mellingen (CH)

(73) Assignee: Spinnler Engineering, Mellingen (CH)

( * ) Notice: Subject to any disclaimer, the term of this patent is extended or adjusted under 35 U.S.C. 154(b) by 241 days.

(21) Appl. No.: 12/578,164

(22) Filed: Oct. 13, 2009

(65) Prior Publication Data

US 2010/0034682 A1 Feb. 11, 2010

Related U.S. Application Data

(63) Continuation of application No. PCT/CH2007/000275, filed on Jun. 1, 2007.

(30) Foreign Application Priority Data

Apr. 17, 2007 (CH) ..... 629/07

(51) Int. Cl.
*F01L 9/02* (2006.01)

(52) U.S. Cl. ..... 123/90.12; 123/90.13; 123/90.33; 123/90.37; 123/90.39; 184/11.2; 418/55.6

(58) Field of Classification Search ..... 123/90.12, 123/90.13, 90.33, 90.37, 90.39; 184/5, 11.2; 418/55.1, 55.6

See application file for complete search history.

(56) References Cited

U.S. PATENT DOCUMENTS

| | | | |
|---|---|---|---|
| 5,024,589 | A | 6/1991 | Jetzer et al. |
| 6,261,069 | B1 | 7/2001 | Djordjevic |

FOREIGN PATENT DOCUMENTS

| | | | |
|---|---|---|---|
| DE | 27 08 527 | | 9/1977 |
| DE | 33 20 086 | A1 | 12/1984 |
| DE | 33 44 015 | A1 | 6/1985 |
| DE | 33 47 081 | A1 | 7/1985 |
| EP | 0 614 012 | A1 | 9/1994 |
| JP | 05 288174 | A | 11/1993 |
| JP | 07 151079 | A | 7/1995 |

*Primary Examiner* — Ching Chang

(74) *Attorney, Agent, or Firm* — Henry M. Feiereisen; Ursula B. Day

(57) ABSTRACT

A scroll compressor for compressible fluids includes a fixed housing having a spiral-shaped feed chamber which contains a working fluid. A displacement member interacts with the feed chamber and includes a driveshaft which is supported in the housing and has an eccentric disk, a carrier disk which is mounted on the driveshaft, and spiral blades which extend out from both sides of the carrier disk. The displacement member is supported by a bearing on the eccentric disk. A lubricant supply system feeds lubricant to the bearing via the driveshaft and the eccentric disk, with a seal assembly sealing a lubricant chamber against the feed chamber. A pressure regulating valve substantially maintains during operation a differential between a pressure in the feed chamber acting on one side of the seal assembly and a pressure in the lubricant chamber acting on another side of the seal assembly, with the pressure regulating valve being acted upon by the pressure in the feed chamber and by the pressure in the lubricant chamber.

6 Claims, 4 Drawing Sheets

SCROLL COMPRESSOR WITH TWO SCROLLS

CROSS-REFERENCES TO RELATED APPLICATIONS

This application is a continuation of prior filed copending PCT International Appl. No. PCT/CH2007/000275, filed Jun. 1, 2007, which designated the United States and has been published as International Publication No. WO 2008/124950 and on which priority is claimed under 35 U.S.C. §120, and which claims the priority of Swiss Patent Application, Serial No. 629/07, filed Apr. 17, 2007, pursuant to 35 U.S.C. 119 (a)-(d).

The contents of PCT/CH2007/000275 and CH 629/07 are incorporated herein by reference in its entirety as if fully set forth herein.

BACKGROUND OF THE INVENTION

The present invention relates to a scroll compressor with two scrolls for compressible fluids.

The following discussion of related art is provided to assist the reader in understanding the advantages of the invention, and is not to be construed as an admission that this related art is prior art to this invention.

Scroll compressors with two scrolls operate at virtually pulsation-free feeding of gaseous working fluid, e.g. air, and may find application for supercharging internal combustion engines, among other purposes. During operation of this type of compressor, a plurality of approximately crescent-shaped work chambers are enclosed in the displacement chamber or feed chamber between a spiral displacement member and two peripheral walls of the displacement chamber and move from an inlet through the displacement chamber toward the outlet, whereby the volume of the displacement chamber steadily decreases while the pressure of the working fluid correspondingly increases. An example of such a scroll compressor is disclosed in German patent document DE 33 47 081 A1. The displacement member is driven by an eccentric shaft and is held by a bearing upon the eccentric of the eccentric shaft. This bearing requires lubrication, using a lubricant, e.g. oil, contained in a lubricant chamber. To seal the lubricant chamber against the feed chamber, shaft sealing rings are typically used which are provided at the bearings of the driveshaft in a housing as well as at the bearings of the displacement member. In certain load situations, the pressure in the feed chamber can exceed the pressure in the lubricant chamber so that there is a risk that the shaft sealing rings become detached from the shaft and thus from the eccentric during operation. As a result, working fluid, e.g. air, may migrate to the lubricant side of the shaft sealing rings and escape through a lubricant recirculation line. A loss of working fluid adversely affects operation of the scroll compressor, in particular when operating at low speed.

It would be desirable and advantageous to provide an improved scroll compressor to obviate prior art shortcomings.

SUMMARY OF THE INVENTION

According to one aspect of the present invention, a scroll compressor for compressible fluids includes a fixed housing having a spiral-shaped feed chamber which contains a working fluid, a driveshaft supported in the housing and having an eccentric disk, a displacement member interacting with the feed chamber and including, a carrier disk, and spiral blades extending out from both sides of the carrier disk, a bearing supporting the carrier disk of the displacement member on the eccentric disk of the driveshaft, a lubricant supply system having a lubricant chamber which contains lubricant and feeding lubricant to the bearing via the driveshaft and the eccentric disk, a seal assembly sealing the lubricant chamber against the feed chamber, and a pressure regulating valve constructed to substantially maintain during operation a differential between a pressure in the feed chamber acting on one side of the seal assembly and a pressure in the lubricant chamber acting on another side of the seal assembly, with the pressure regulating valve being acted upon by the pressure in the feed chamber and by the pressure in the lubricant chamber.

The present invention resolves prior art problems by keeping the differential between the pressure in the feed chamber acting on one side of the seal assembly and the pressure in the lubricant chamber acting on the other side of the seal assembly during operation substantially constant, so that a detachment of the sealing assembly is effectively prevented. This is true at any working pressure in the feed chamber.

According to another advantageous feature of the present invention, the lubricant supply system may include a lubricant recirculation connected to the lubricant chamber, with the pressure regulating valve being arranged in the lubricant recirculation.

According to yet another advantageous feature of the present invention, the pressure regulating valve may be constructed in the form of a diaphragm valve.

According to still another advantageous feature of the present invention, the lubricant recirculation can have a lubricant recirculation line in communication with the lubricant chamber, wherein the pressure regulating valve has a flexible diaphragm which includes a control member having one side placed in opposition to an exit opening of the lubricant recirculation line, and another side subjected to the force in the feed chamber, wherein the control member can be constructed to control a lubricant outflow from the exit opening of the lubricant recirculation line in dependence on the differential between the pressure in the feed chamber and the pressure in the lubricant chamber.

According to yet another advantageous feature of the present invention, the lubricant chamber can have a first compartment on one side of the bearing and a second compartment on another side of the bearing, wherein a tubular guide sleeve is placed in a length bore in the driveshaft and has formed therein a lubricant feed passageway which is in communication with a lubricant source and in communication with one of the first and second compartments of the lubricant chamber, wherein the guide sleeve is defined by a first outer diameter and has a section extending over part of the guide sleeve and defined by a second outer diameter which is smaller than the first outer diameter to form with a wall of the length bore a lubricant recirculation passageway which is in communication with the other one of the first and second compartments of the lubricant chamber and in communication with the lubricant recirculation passageway.

According to yet another advantageous feature of the present invention, the lubricant supply system may include a flow limiter.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
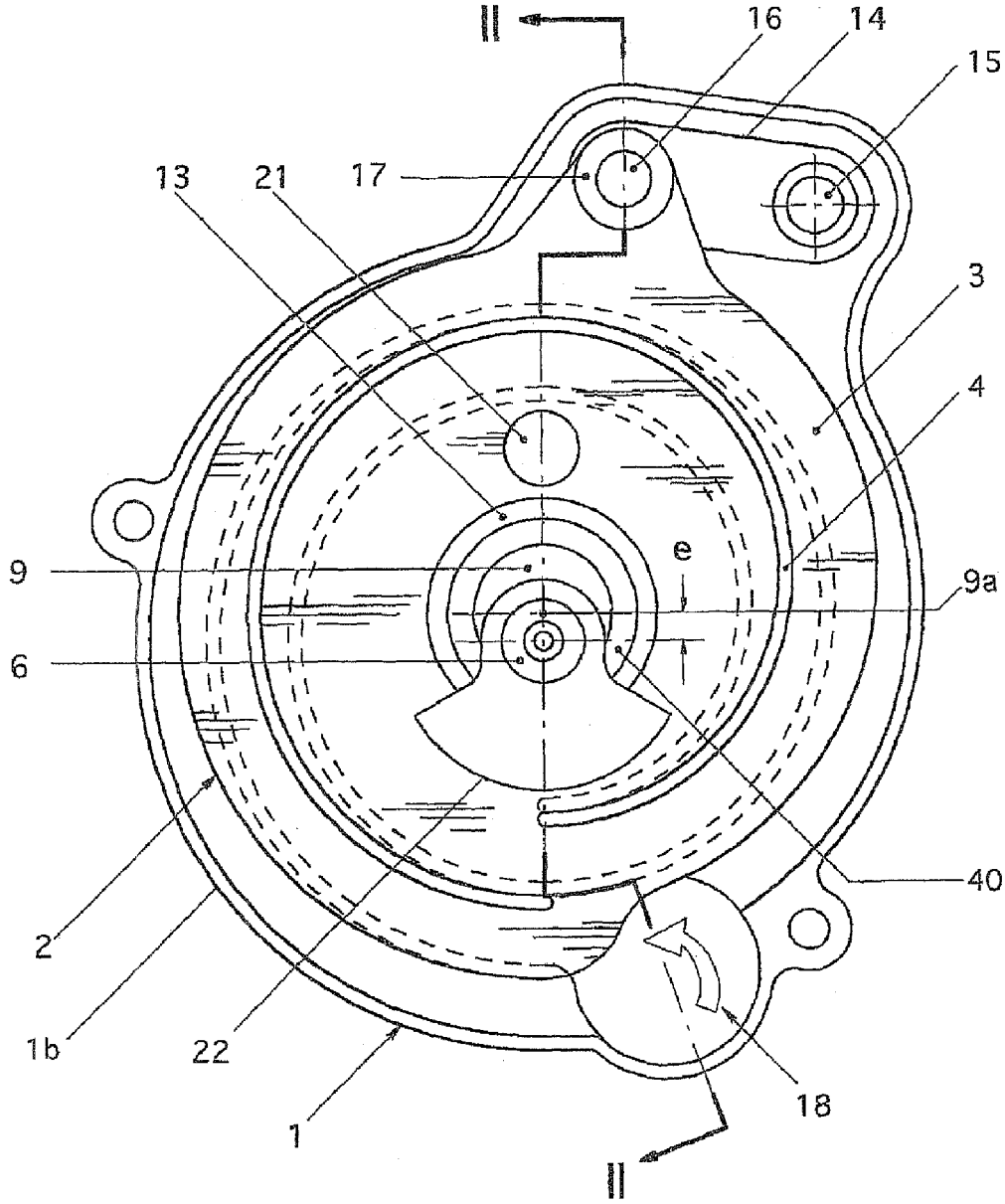
FIG. 1 is a front elevation in a direction of arrow A in FIG. 2 of a drive-side housing part of a scroll compressor according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
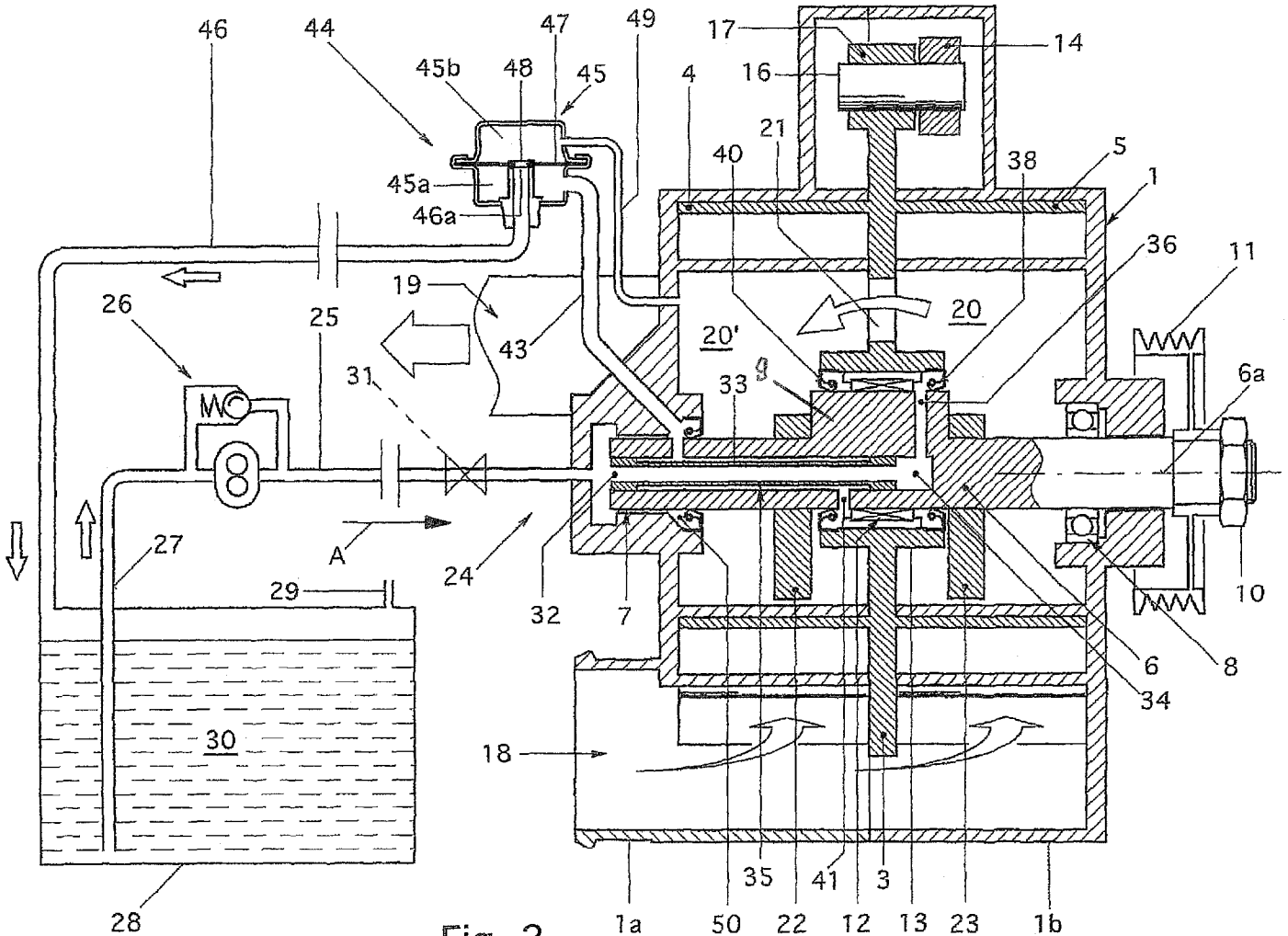
FIG. 2 is a longitudinal section of the scroll compressor of FIG. 1, taken along the line II-II in FIG. 1.

Turning now to the drawing, and in particular to FIG. 1, there is shown a front elevation in a direction of arrow A in FIG. 2 of a drive-side housing part of a scroll compressor according to the present invention. The scroll compressor includes a housing, generally designated by reference numeral 1 and including two housing parts 1*a*, 1*b* (FIG. 2) for support of a displacement member 2. Both housing parts 1*a*, 1*b* are bolted together in a manner not shown in detail. In the illustration of FIG. 1, housing part 1*a* has been removed.

The displacement member 2 includes a carrier disk 3 which carries on one side thereof a spirally extending displacement element or scroll 4 and on the other side thereof a spirally extending displacement element or scroll 5. The displacement elements 4, 5, are configured as ribs in the form of spiral blades which project out from the disk 3. The disk 3 is supported by a driveshaft 6 which rotates about a rotation axis 6*a*. The driveshaft 6 is supported in the housing parts 1*a*, 1*b* by bearings 7 and 8, respectively, and includes an eccentric disk 9 which defines a symmetry axis 9*a*. The distance between the rotation axis 6*a* of the driveshaft 6 and the symmetry axis 9*a* of the eccentric disk 9 (eccentricity) is designated with "e" in FIG. 1. A screw fastener 10 secures a driving belt pulley 11 to the driveshaft 6.

The carrier disk 3 has a hub 13 which is supported on the eccentric disk 9 by a bearing 12, e.g. a rolling-contact bearing. The disk 3 and thus the displacement body 2 is driven via the driveshaft 6 and the eccentric disk 9. The driving force is hereby transmitted via the bearing 12 onto the hub 13 of the disk 3. The displacement member 2 is guided by a rocker 14 which has one end rotatably supported on a shaft 15 (FIG. 1). The other end of the rocker 14 carries a bolt 16 which is rotatably supported in an eye 17 of the disk 3.

The housing 1 has an inlet 18 and an outlet 19 for the feed medium, e.g. air, as well as two feed chambers 20, 20'. The disk 3 has an opening 21 (or several openings) to enable the feed medium to flow from the feed chamber 20 into the feed chamber 20'.

Counterweights 22, 23 are disposed on the driveshaft 6 in order to compensate forces of mass, when the displacement body 2 is driven eccentrically.

The bearing 12, disposed between the eccentric disk 9 and the hub 13 of the disk 3, is lubricated by a lubricant supply system 24 shown in greater detail in FIG. 2 which is a longitudinal section of the scroll compressor of FIG. 1, taken along the line II-II in FIG. 1, for supplying the bearing 12 with lubricant 30, e.g. lubricating oil.

The lubricant supply system 24 includes a supply line 25 which is connected to the housing 1 and connected with the pressure side of a pressure-controlled feed pump 26. This type of pump with pressure control is used in internal combustion engines and generates a lubricant delivery pressure which remains within certain limits at operation. On the suction side, the feed pump 26 is connected via a suction line 27 with a lubricant reservoir 28 which is in fluid communication with the surroundings via a connection line 29. As a result, ambient pressure acts constantly on the surface of the lubricant 30 in the lubricant reservoir 28. A flow limiter 31, e.g. a flow limiting valve, may be disposed in the supply line 25 and is indicated in FIGS. 2 to 4 by a broken line.

Figure 3:
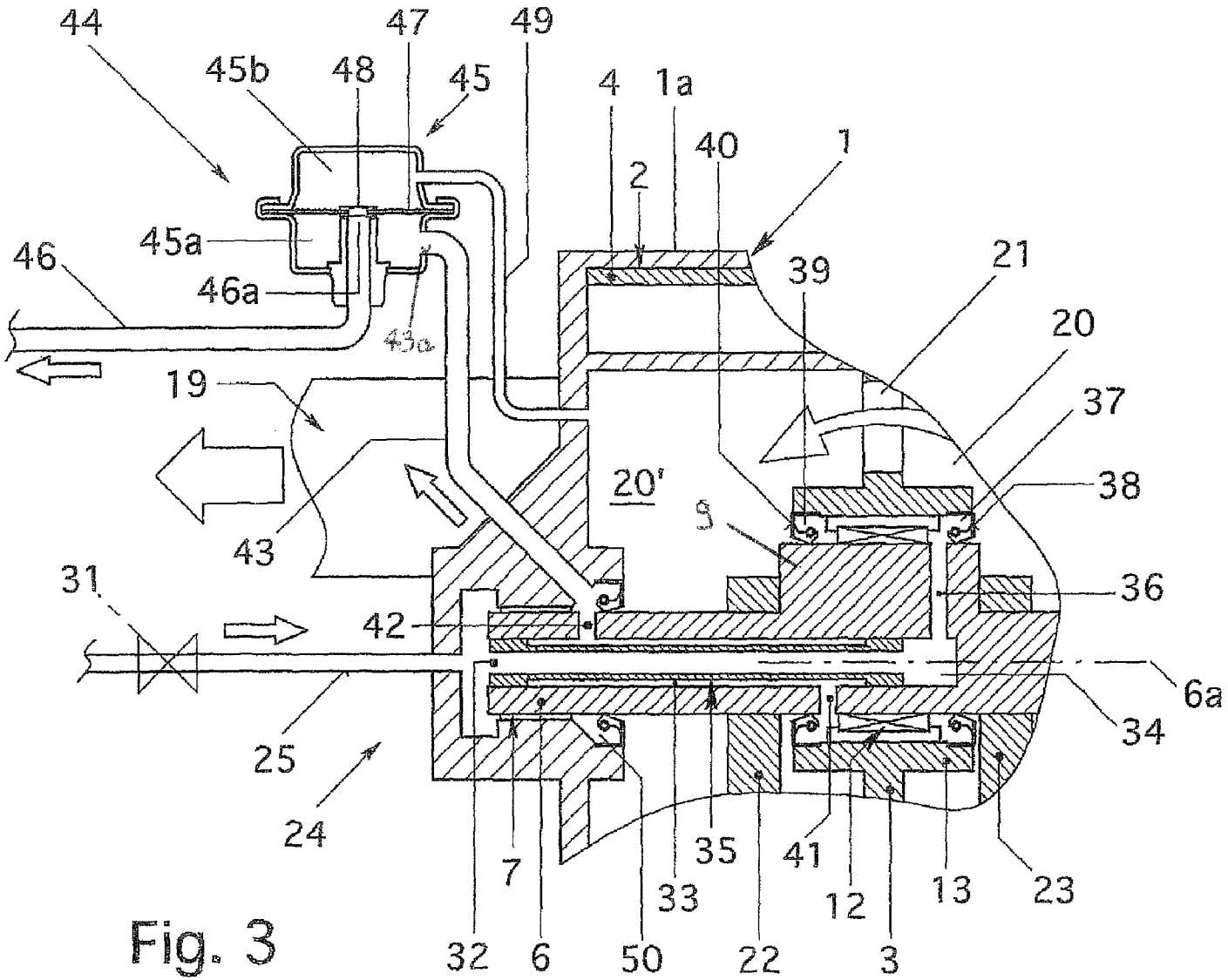
FIG. 3 is an enlarged detailed view of a section of the scroll compressor.

The driveshaft 6 has a lubricant feed channel 32 and a lubricant recirculation channel 33 in coaxial relationship to the rotation axis 6*a* of the driveshaft 6 (FIGS. 2 and 3). The two channels 32, 33 are formed by placing in a length bore 34 in the driveshaft 6 a tubular guide sleeve 35 which has on its outside a section of smaller outer diameter along a portion of the length of the guide sleeve 35 so as to define the lubricant recirculation channel 33 with the wall of the length bore 34. The lubricant feed channel 32 inside the guide sleeve 35 is fluidly connected with the feed channel 36 which extends in radial direction in the eccentric disk 9 and feeds into a first lubricant compartment 37 on the one side of the bearing 12, as shown in FIG. 3. The first lubricant compartment 37 is sealed against the feed chamber 20 by a ring-shaped sealing element 38 which bears upon the eccentric disk 9. A second lubricant compartment 39 is located on the other side of the bearing 12 and sealed against the feed chamber 20' by a ring-shaped sealing element 40 which also bears upon the eccentric disk 9. The second lubricant compartment 39 is fluidly connected with the lubricant recirculation channel 33 via a radial outflow channel 41 in the eccentric disk 9.

Figure 4:
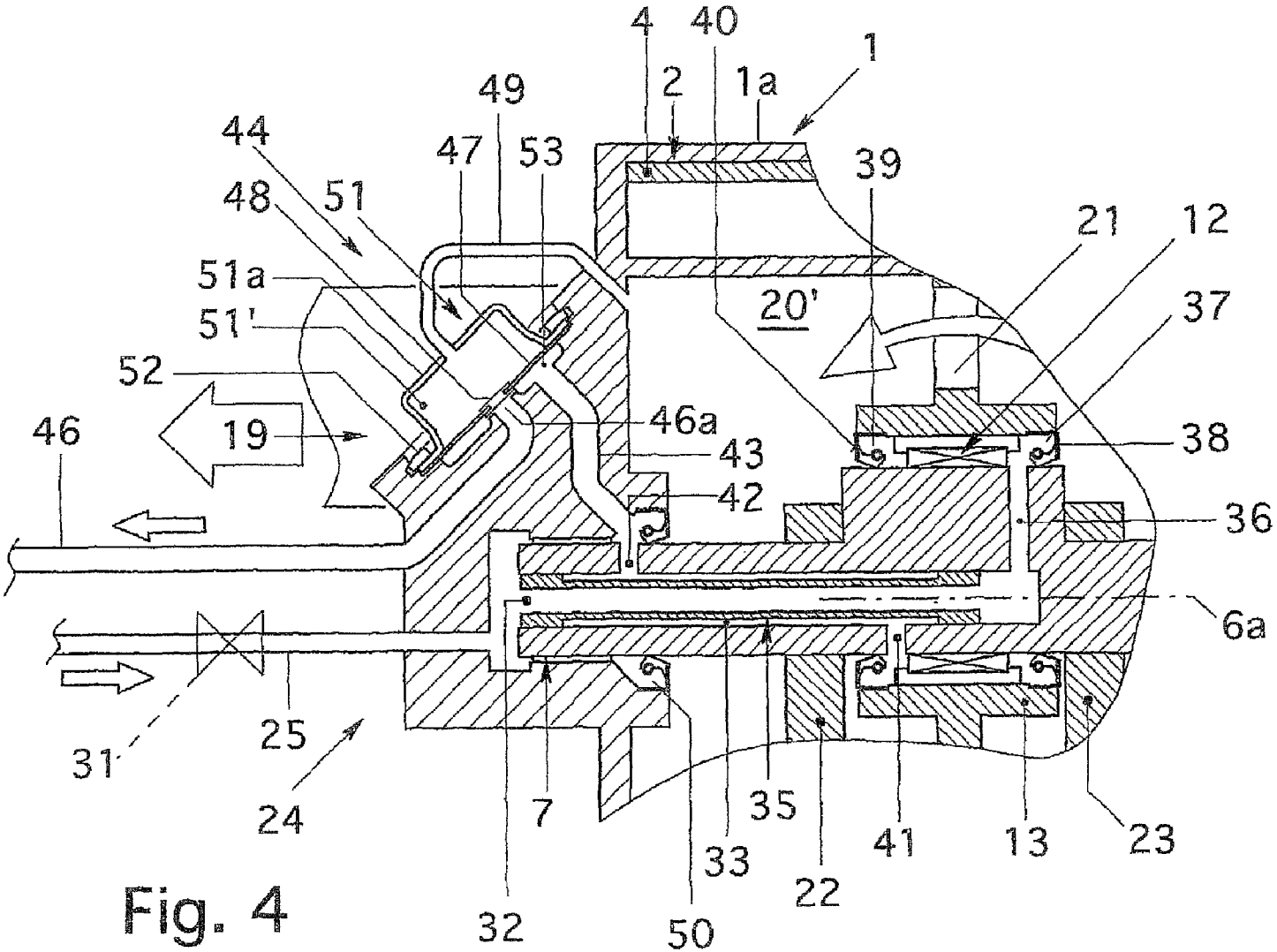
FIG. 4 is an enlarged detailed view of a section similar to FIG. 3 of another embodiment of a scroll compressor according to the present invention.

A radial connection channel 42 in the driveshaft 6 connects the lubricant recirculation channel 33 with a lubricant recirculation line 43 which is part of a lubricant recirculation system, generally designated in FIGS. 2 to 4 by reference numeral 44. The lubricant recirculation line 43 is connected with the inlet of a pressure regulating valve 45 having an outlet which is fluidly connected with the lubricant reservoir 28 via a return line 46. The pressure regulating valve 45 is constructed in the form of a diaphragm valve and has a diaphragm 47 to divide the interior space of the pressure regulating valve 45 into two chambers 45*a*, 45*b*. The diaphragm 47 has a control member 48 approximately in midsection of the diaphragm 47 in opposition to an exit opening 43*a* of the lubricant recirculation line 43 for controlling the lubricant outflow from the lubricant recirculation line 43 into the chamber 45*a*. The chamber 45*b* of the pressure regulating valve 45 in opposition to the chamber 45*a* is fluidly connected with the feed chamber 20' via a connection line 49. As a result, the pressure in the chamber 45*b* corresponds to the working pressure in the feed chamber 20'. The feed chamber 20' is sealed off to the outside by a ring-shaped sealing element 50 which bears upon the driveshaft 6.

Lubricant conveyed from the feed pump 26 flows via the supply line 25, the lubricant feed channel 32, and the feed channel 36 to the first lubricant compartment 37. From the first lubricant compartment 37, lubricant passes through the bearing 12 into the second lubricant compartment 39. From the second lubricant compartment 39, lubricant flows to the chamber 45*a* of the pressure limiting valve 45 via the outflow channel 41, the lubricant recirculation channel 33, the connection channel 42, and the lubricant recirculation line 43.

From the chamber 45*a*, lubricant flows back into the lubricant reservoir 28 via the return line 46.

The diaphragm 27 is deflected more or less downwards in the direction of the exit opening 43*a* of the lubricant recirculation line 43 in dependence on the magnitude of the delivery or working pressure prevailing in the feed chamber 20', which pressure is present also in the chamber 45*b* of the pressure limiting valve 45. As a result, the distance between the control member 48 and the exit opening 43*a* of the lubricant recirculation line 43 increases or decreases in dependence on the difference of the pressures in the chambers 45*a*, 45*b*, so that the amount of lubricant flowing out of the lubricant recirculation line 43 into the chamber 45*a* is correspondingly adjusted. In this way, the pressure in the lubricant recirculation line 43 and thus also in the lubricant compartments 37, 39 is changed in dependence on the delivery or working pressure in the feed compartment 20'. In the event the pressure in the feed chamber 20' rises, the distance between the control member 48 and the exit opening 43*a* decreases, causing a backup of returning lubricant and thus to a pressure increase in the lubricant recirculation system 44 and in the lubricant compartments 37, 39. As a consequence, a pressure rise in the feed chamber 20' is necessarily accompanied by a pressure rise in the lubricant compartments 37, 39. In this way, it is attained that the pressure differential between the pressures on both sides of the sealing elements 38, 40 remains approximately the same at any time, regardless whether the delivery pressure in the feed chamber 20' is higher or lower during operation of the scroll compressor. As the difference between the pressure acting in the feed chambers 20, 20' on the one side of the sealing elements 38, 40 and the pressure acting in the lubricant chambers 37, 39 on the other side of the sealing elements 38, 40 remains substantially constant, a detachment of the sealing elements 38, 40 from the eccentric disk 9 is prevented during operation.

Referring now to FIG. 4, there is shown an enlarged detailed view of another embodiment of a scroll compressor according to the present invention. Parts corresponding with those in FIGS. 1-3 are denoted by identical reference numerals and not explained again. The description below will center on the differences between the embodiments. In this embodiment, provision is made for a direct securement of the housing 51*a* and the diaphragm 47 with the control member 48 of the pressure regulating valve 51 upon the housing part 1*a*, e.g. by means of a snap ring 52. A chamber 51' is formed by the housing 51*a* and the diaphragm 47 and is in fluid communication with the feed chamber 20' via the connection line 49. The lubricant recirculation line 43 feeds with its exit opening 43*a* into a chamber 53 which is formed in the housing part 1*a* and is part of the pressure regulating valve 51 and which is closed by the diaphragm 47 and connected to the return line 46. The control member 48 of the diaphragm 47 is positioned, like in the embodiment of FIG. 3, in opposition to the exit opening 43*a* of the lubricant recirculation line 43 and provided to control the amount of lubricant flowing out of the exit opening 43*a*.

The mode of operation of the pressure regulating valve 51 is the same as the afore-described mode of operation of the pressure regulating valve 45 of FIG. 3.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A scroll compressor for compressible fluids, comprising:

a fixed housing having a spiral-shaped feed chamber which contains a working fluid;

a driveshaft supported in the housing and having an eccentric disk;

a displacement member interacting with the spiral-shaped feed chamber and including, a carrier disk, and spiral blades extending out from both sides of the carrier disk;

a bearing supporting the carrier disk of the displacement member on the eccentric disk of the driveshaft;

a lubricant supply system having a lubricant chamber which contains lubricant and feeding lubricant to the bearing via the driveshaft and the eccentric disk;

a seal assembly sealing the lubricant chamber against the spiral-shaped feed chamber; and a pressure regulating valve constructed to substantially maintain during operation a differential between a pressure in the spiral-shaped feed chamber acting on one side of the seal assembly and a pressure in the lubricant chamber acting on another side of the seal assembly, with the pressure regulating valve being acted upon by the pressure in the spiral-shaped feed chamber and by the pressure in the lubricant chamber.

2. The scroll compressor of claim 1, wherein the lubricant supply system includes a lubricant recirculation connected to the lubricant chamber, said pressure regulating valve being arranged in the lubricant recirculation.

3. The scroll compressor of claim 2, wherein the lubricant recirculation has a lubricant recirculation line in communication with the lubricant chamber, said pressure regulating valve having a flexible diaphragm which includes a control member having one side placed in opposition to an exit opening of the lubricant recirculation line, and another side subjected to the force in the feed chamber, said control member being constructed to control a lubricant outflow from the exit opening of the lubricant recirculation line in dependence on the differential between the pressure in the feed chamber and the pressure in the lubricant chamber.

4. The scroll compressor of claim 3, wherein the lubricant chamber has a first compartment on one side of the bearing and a second compartment on another side of the bearing, and further comprising a tubular guide sleeve placed in a length bore in the driveshaft and having formed therein a lubricant feed passageway which is in communication with a lubricant source and in communication with one of the first and second compartments of the lubricant chamber, said guide sleeve defined by a first outer diameter and having a section extending over part of the guide sleeve and defined by a second outer diameter which is smaller than the first outer diameter to form with a wall of the length bore a lubricant recirculation passageway which is in communication with the other one of the first and second compartments of the lubricant chamber and in communication with the lubricant recirculation passageway.

5. The scroll compressor of claim 1, wherein the pressure regulating valve is constructed in the form of a diaphragm valve.

6. The scroll compressor of claim 1, wherein the lubricant supply system includes a flow limiter.

* * * * *